US005173207A

United States Patent [19]

Drapier et al.

[11] Patent Number: 5,173,207

[45] Date of Patent: Dec. 22, 1992

[54] POWERED AUTOMATIC DISHWASHING COMPOSITION CONTAINING ENZYMES

[75] Inventors: Julien Drapier, Seraing; Patrick Durbut, Verviers, both of Belgium; Fahim U. Ahmed, Dayton, N.J.

[73] Assignee: Colgate-Palmolive Company, New York, N.Y.

[21] Appl. No.: 708,576

[22] Filed: May 31, 1991

[51] Int. Cl.[5] ..... C11D 3/395; C11D 3/386; C11D 3/08; C11D 3/37

[52] U.S. Cl. ..... 252/99; 252/174.12; 252/174.23; 252/DIG. 2; 252/DIG. 12; 435/264

[58] Field of Search ..... 252/DIG. 12, DIG. 2, 252/174.23, 174.12, 99; 435/264

[56] References Cited

U.S. PATENT DOCUMENTS

| | | | |
|---|---|---|---|
| 4,162,987 | 7/1979 | Maguire et al. | 252/135 |
| 4,501,681 | 2/1985 | Groult | 252/174.12 |
| 4,597,886 | 7/1986 | Goedhart | 252/95 |
| 4,620,936 | 11/1986 | Kielman et al. | 252/99 |
| 4,753,748 | 6/1988 | Lailem et al. | 252/99 |
| 4,810,413 | 3/1989 | Pancheri et al. | 252/174.12 |
| 4,900,475 | 2/1990 | Ramachandran | 252/532 |
| 4,931,195 | 6/1990 | Cao et al. | 252/8.8 |

OTHER PUBLICATIONS

J. H. Van EE, Protein Engineering as a Tool to Obtain Better Proteases for Use in Detergents, Chimicaoggi Jul. 1991.

*Primary Examiner*—A. Lionel Clingman
*Assistant Examiner*—Kery A. Fries
*Attorney, Agent, or Firm*—Richard E. Nanfeldt; Robert C. Sullivan; Murray Grill

[57] ABSTRACT

A phospate-free powdered dishwashing composition containing a mixture of protease enzyme and anamylase enzymes have been found to be very useful in the cleaning of dishware. The compositions contain nonionic surfactants and a alkali metal silicate and bleaching agent.

9 Claims, No Drawings

POWERED AUTOMATIC DISHWASHING COMPOSITION CONTAINING ENZYMES

FIELD OF THE INVENTION

This invention relates to an improved powdered phosphate-free automatic dishwashing detergent for dishwashing machines. More particularly, this invention relates to a concentrated powdered dishwashing composition which contains enzymes and is phosphate-free.

BACKGROUND OF THE INVENTION

It has been found to be very useful to have enzymes in dishwashing detergent compositions because enzymes are very effective in removing food soils from the surface of glasses, dishes, pots, pans and eating utensils. The enzymes attack these materials while other components of the detergent will effect other aspects of the cleaning action. However, in order for the enzymes to be highly effective, the composition must be chemically stable, and it must maintain an effective activity at the operating temperature of the automatic dishwasher. Chemical stability such as to bleach agents is the property whereby the detergent composition containing enzymes does not undergo any significant degradation during storage. Activity is the property of maintaining enzyme activity during usage. From the time that a detergent is packaged until it is used by the customer, it must remain stable. Furthermore, during customer usage of the dishwashing detergent, it must retain its activity. Unless the enzymes in the detergent are maintained in a minimum exposure moisture and water, the enzymes will suffer a degradation during storage which will result in a product that will have a decreased activity. When enzymes are a part of the detergent composition, it has been found that the initial water content of the components of the composition should be as low a level as possible, and this low water content must be maintained during storage, since water will deactivate the enzymes. This deactivation will cause a decrease in the initial deactivity of the detergent composition.

After the detergent container is opened, the detergent will be exposed to the environment which contains moisture. During each instance that the detergent is exposed to the environment it could possibly absorb some moisture. This absorption occurs by components of the detergent composition absorbing moisture, when in contact with the atmosphere. This effect is increased as the container is emptied, since there will be a greater volume of air in contact with the detergent, and thus more available moisture to be absorbed by the detergent composition. This will usually accelerate the decrease in the activity of the detergent composition. The most efficient way to keep a high activity is to start with an initial high activity of enzyme and to use components in the dishwashing composition which do not interact with the enzyme or which have a low water affinity which will minimize any losses in activity as the detergent is being stored or used.

Powdered detergent compositions which contain enzymes can be made more stable and to have a high activity, if the initial free water content of the detergent composition is less than about 10 percent by weight, more preferably less than about 9 percent by weight and most preferably less than about 8 percent by weight. Furthermore, the pH of a 1.0 wt % aqueous solution of the powdered detergent composition should be less than about 10.5 more preferably less than about 10.0, and most preferably less than about 9.5. This low alkalinity of the dishwashing detergent should maintain the stability of the detergent composition which contains a mixture of enzymes, thereby providing a higher initial activity of the mixture of the enzymes and the maintenance of this initial high activity.

A major concern in the use of automatic dishwashing compositions is the formulation of phosphate-free compositions which are safe to the environment while maintaining superior cleaning performance and dish care. The present invention teaches the preparation and use of powdered automatic dishwashing compositions which are phosphate-free and have superior cleaning performance and dish care.

SUMMARY OF THE INVENTION

This invention is directed to producing powdered phosphate-free enzyme-containing automatic dishwashing detergent compositions that have an increased chemical stability and essentially a high activity at wash operating temperatures of about 40° C. to 65° C., wherein the composition also can be used as a laundry pre-soaking agent. This is accomplished by controlling the alkalinity of the detergent composition and using a unique mixture of enzymes. An alkali metal silicate is used in the powdered dishwashing detergent compositions. The preferred builder system of the instant compositions comprises a mixture of sodium carbonate and/or sodium citrate and a low molecular weight polyacrylic polymer.

It is to be understood that the term powder in this invention includes within its definition tablets, soluble capsules and soluble sachet. It is also possible to use the instant compositions as a laundry presoaking powder.

Conventional powdered automatic dishwashing compositions usually contain a low foaming surface-active agent, a chlorine bleach, alkaline builder materials, and usually minor ingredients and additives. The incorporation of chlorine bleach requires special processing and storage precautions to protect composition components which are subject to deterioration upon direct contact with the active chlorine. The stability of the chlorine bleach is also critical and raises additional processing and storage difficulties. In addition, it is known that automatic dishwasher detergent compositions may tarnish silverware and damage metal trim on china as a result of the presence of a chlorine-containing bleach therein. Accordingly, there is a standing desire to formulate detergent compositions for use in automatic dishwashing operations which are free of active chlorine and which are capable of providing overall hard surface cleaning and appearance benefits comparable to or better than active chlorine-containing detergent compositions. This reformulation is particularly delicate in the context of automatic dishwashing operations, since during those operations, the active chlorine prevents the formation and/or deposition of troublesome protein and protein-grease complexes on the hard dish surfaces and no surfactant system currently known is capable of adequately performing that function.

Various attempts have been made to formulate bleach-free low foaming detergent compositions for automatic dishwashing machines, containing particular low foaming nonionics, builders, filler materials and enzymes. U.S. Pat. No. 3,472,783 to Smille recognized that degradation of the enzyme can occur, when an enzyme is added to a highly alkaline automatic dishwashing detergent.

French Patent No. 2,102,851 to Colgate-Palmolive, Pertains to rinsing and washing compositions for use in automatic dishwashers. The compositions disclosed have a pH of about 6 to 7 and contain an amylolytic and, if desired, a proteolytic enzyme, which have been prepared in a special manner from animal pancreas and which exhibit a desirable activity at a pH in the range of about 6 to 7. German Patent No. 2,038,103 to Henkel & Co. relates to aqueous liquid or pasty cleaning compositions containing phosphate salts, enzymes and an enzyme stabilizing compound. U.S. Pat. No. 3,799,879 to Francke et al, teaches a detergent composition for cleaning dishes, with a pH of from 7 to 9 containing an amylolytic enzyme, and in addition, optionally a proteolytic enzyme.

U.S. Pat. No. 4,101,457, to Place et al., teaches the use of a proteolytic enzyme having a maximum activity at a pH of 12 in an automatic dishwashing detergent.

U.S. Pat. No. 4,162,987, to Maguire et al., teaches a granular or liquid automatic dishwashing detergent which uses a proteolytic enzyme having a maximum activity at a pH of 12 as well as an amylolytic enzyme having a maximum activity at a pH of 8.

U.S. Pat. No. 3,827,938, to Aunstrup et al., discloses specific proteolytic enzymes which exhibit high enzymatic activities in highly alkaline systems. Similar disclosures are found in British Patent Specification No. 1,361,386, to Novo Terapeutisk Laboratorium A/S. British Patent Specification No. 1,296,839, to Novo Terapeutisk Laboratorium A/S, discloses specific amylolytic enzymes which exhibit a high degree of enzymatic activity in alkaline systems.

Thus, while the prior art clearly recognizes the disadvantages of using aggressive chlorine bleaches in automatic dishwashing operations and also suggests bleach-free compositions made by leaving out the bleach component, said art disclosures are silent about how to formulate an effective bleach-free powdered automatic dishwashing compositions capable of providing superior performance during conventional use.

U.S. Pat. Nos. 3,821,118 and 3,840,480; 4,568,476, 4,501,681 and 4,692,260 teach the use of enzymes in automatic dishwashing detergents, as well as Belgian Patent 895,459; French Patents 2,544,393 and 1,600,256;

European patents 256,679; 266,904; 271,155; 139,329; and 135,226; and Great Britain Patent 2,186,884.

The aforementioned prior art fails to provide a powdered automatic dishwashing detergent which is phosphate-free and contains a mixture of enzymes for the simultaneous degradation of both proteins and starches, wherein the combination of enzymes have a maximum activity at a pH of less than about 10 as measured by Anson method and the powdered automatic dishwashing detergent has optimized cleaning performance in a temperature range of about 40° C. to about 65° C.

It is an object of this invention to incorporate an enzyme mixture in a phosphate-free, powdered automatic dishwasher detergent composition for use in automatic dishwashing operations capable of providing at least equal or better performance to conventional automatic dishwashing compositions at operating temperatures of about 40° C. to about 65° C.

DETAILED DESCRIPTION

The present invention relates to a powdered automatic dishwashing detergent compositions which comprise a nonionic surfactant, alkali metal silicate, a phosphate-free builder system, a peroxygen compound with activator as a bleaching agent and a mixture of an amylase enzyme and a protease enzyme, wherein the powdered automatic dishwashing detergent composition has a pH of less than 10 in the washing liquor at a concentration of 10 grams per liter of water and the powdered dishwashing detergent composition exhibits high cleaning efficiency for both proteins and starches at a wash temperature of about 40° C. to about 65° C.

The nonionic surfactants that can be used in the present powdered automatic dishwasher detergent compositions are well known. A wide variety of these surfactants can be used.

The nonionic synthetic organic detergents are generally described as ethoxylated propoxylated fatty alcohols which are low-foaming surfactants and are possibly capped, characterized by the presence of an organic hydrophobic group and an organic hydrophilic group and are typically produced by the condensation of an organic aliphatic or alkyl aromatic hydrophobic compound with ethylene oxide and/or propyleneoxide (hydrophilic in nature). Practically any hydrophobic compound having a carboxy, hydroxy, amido or amino group with a free hydrogen attached to the oxygen or the nitrogen can be condensed with ethylene oxide or propylene oxide or with the polyhydration product thereof, polyethylene glycol, to form a nonionic detergent. The length of the hydrophilic or polyoxy ethylene chain can be readily adjusted to achieve the desired balance between the hydrophobic and hydrophilic groups. Typical suitable nonionic surfactants are those disclosed in U.S. Pat. Nos. 4,316,812 and 3,630,929.

Preferably, the nonionic detergents that are used are the low-foaming polyalkoxylated lipophiles wherein the desired hydrophile-lipophile balance is obtained from addition of anhydrophilic poly-lower alkoxy group to a lipophilic moiety. A preferred class of the nonionic detergent employed is the poly-lower alkoxylated higher alkanol wherein the alkanol is of 9 to 18 carbon atoms and wherein the number of moles of lower alkylene oxide (of 2 or 3 carbon atoms) is from 3 to 15. Of such materials it is preferred to employ those wherein the higher alkanol is a high fatty alcohol of 9 to 11 or 12 to 15 carbon atoms and which contain from 5 to 15 or 5 to 16 lower alkoxy groups per mole. Preferably, the lower alkoxy is ethoxy but in some instances, it may be desirably mixed with propoxy, the latter, if present, usually being major (more than 50%) portion. Exemplary of such compounds are those wherein the alkanol is of 12 to 15 carbon atoms and which contain about 7 ethylene oxide groups per mole.

Useful nonionics are represented by the low foam Plurafac series from BASF Chemical Company which are the reaction product of a higher linear alcohol and a mixture of ethylene and propylene oxides, containing a mixed chain of ethylene oxide and propylene oxide, terminated by a hydroxyl group. Examples include Product A(a $C_{13}$–$C_{15}$ fatty alcohol condensed with 6 moles ethylene oxide and 3 moles propylene oxide). Product B (a $C_{13}$–$C_{15}$ fatty alcohol condensed with 7 mole propylene oxide and 4 mole ethylene oxide), and Product C (a $C_{13}$–$C_{15}$ fatty alcohol condensed with 5 moles propylene oxide and 10 moles ethylene oxide).

Particularly good surfactants are Plurafac LF132 and LF 231 which are capped nonionic surfactants. Another liquid nonionic surfactant that can be used is sold under the tradename Lutensol SC 9713.

Synperonic nonionic surfactant from ICI such as Synperonic LF/D25 are especially preferred nonionic surfactants that can be used in the powdered automatic dishwasher detergent compositions of the instant invention.

Other useful surfactants are Neodol 25-7 and Neodol 23-6.5, which products are made by Shell Chemical Company, Inc. The former is a condensation product of a mixture of higher fatty alcohols averaging about 12 to 13 carbon atoms and the number of ethylene oxide groups present averages about 6.5. The higher alcohols are primary alkanols. Other examples of such detergents include Tergitol 15-S-7 and Tergitol 15-S-9 (registered trademarks), both of which are linear secondary alcohol ethoxylates made by Union Carbide Corp. The former is mixed ethoxylation product of 11 to 15 carbon atoms linear secondary alkanol with seven moles of ethylene oxide and the latter is a similar product but with nine moles of ethylene oxide being reacted.

Also useful in the present compositions as a component of the nonionic detergent are higher molecular weight nonionics, such as Neodol 45-11, which are similar ethylene oxide condensation products of hi9her fatty alcohols, with the higher fatty alcohol being of 14 to 15 carbon atoms and the number of ethylene oxide groups per mole being about 11. Such products are also made by Shell Chemical Company.

In the preferred poly-lower alkoxylated higher alkanols, to obtain the best balance of hydrophilic and lipophilic moieties the number of lower alkoxies will usually be from 40% to 100% of the number of carbon atoms in the higher alcohol, preferably 40 to 60% thereof and the nonionic detergent will preferably contain at least 50% of such preferred poly-lower alkoxy higher alkanol.

The alkylpolysaccharides are surfactants which are also useful alone or in conjunction with the aforementioned surfactants and have those having a hydrophobic group containing from about 8 to about 20 carbon atoms, preferably from about 10 to about 16 carbon atoms, most preferably from 12 to 14 carbon atoms, and polysaccharide hydrophilic group containing from 1.5 to about 10, preferably from about 1.5 to 4, and most preferably from 1.6 to 2.7 saccharide units (e.g., galactoside, glucoside, fructoside, glucosyl, fructosyl, and/or galactosyl units). Mixtures of saccharide moieties may be used in the alkyl polysaccharide surfactants. The number x indicates the number of saccharide units in a particular alkylpolysaccharide surfactant. For a particular alkylpolysaccharide molecule x can only assume integral values. In any physical sample can be characterized by the average value of x and this average value can assume non-integral values. In this specification the values of x are to be understood to be average values. The hydrophobic group (R) can be attached at the 2-, 3-, or 4- positions rather than at the 1-position, (thus giving e.g. a glucosyl or galactosyl as opposed to a glucoside or galactoside). However, attachment through the 1-position, i.e., glucosides, galactosides, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 16 carbon atoms. Preferably, the alkyl group is a straight chain saturated alkyl group. The alkyl group can contain up to 3 hydroxy groups and/or the polyalkoxide chain can contain up to about 30, preferably less than 10, most preferably 0, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkylpolysaccharides. When used in admixture with alkylpolysaccharides, the alkyl monosaccharides are solubilized to some extent. The use of alkyl monosaccharides in admixture with alkylpolysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula:

$$R_2O(C_nH_{2n}O)r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from 12 to 14 carbon atoms; n is 2 or 3 preferably 2, r is from 0 to about 10, preferable 0; and x is from 1.5 to about 8, preferably from 1.5 to 4, most preferably from 1.6 to 2.7. To prepare these compounds a long chain alcohol ($R^2OH$) can be reacted with glucose, in the presence of an acid catalyst to form the desired glucoside. Alternatively the alkylpolyglucosides can be prepared by a two step procedure in which a short chain alcohol ($R_1OH$) an be reacted with glucose, in the presence of an acid catalyst to form the desired glucoside. Alternatively the alkylpolyglucosides can be prepared by a two step procedure in which a short chain alcohol ($C_{1-6}$) is reacted with glucose or a polyglucoside ($x=2$ to 4) to yield a short chain alkyl glucoside ($x=1$ to 4) which can in turn be reacted with a longer chain alcohol ($R^2OH$) to displace the short chain alcohol and obtain the desired alkylpolyglucoside. If this two step procedure is used, the short chain alkylglucoside content of the final alkylpolyglucoside material should be less than 50%, preferably less than 10%, more preferably less than 5%, most preferably 0% of the alkylpolyglucoside.

The amount of unreacted alcohol (the free fatty alcohol content) in the desired alkylpolysaccharide surfactant is preferably less than about 2%, more preferably less than about 0.5% by weight of the total of the alkylpolysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereo chemistry of the saccharide moiety is changed during the preparation reaction.

An especially preferred APG glycoside surfactant is APG 625 glycoside manufactured by the Henkel Corporation of Ambler, PA. APG 25 is a nonionic alkyl polyglycoside characterized by the formula:
$C_nH_{2n+1}O(C_6H_{10}O_5)_xH$ wherein n=10(2%); n=12(65%); n=14(21-28%); n=16(4-8%) and n=18 x(degree of polymerization) =1.6. APG 625 has: a pH of 6-8(10% of APG 625 in distilled water); a specific gravity at 25° C. of 1.1 grams/ml; a density at 25° C. of 9.1 kgs/gallons; a calculated HLB of about 12.1 and a Brookfield viscosity at 35° C., 21 spindle, 5-10 RPM of about 3,000 to about 7,000 cps.

Mixtures of two or more of the liquid nonionic surfactants can be used and in some cases advantages can be obtained by the use of such mixtures.

The liquid nonaqueous nonionic surfactant is absorbed on a builder system which comprises a mixture of phosphate-free particles which is a builder salt and a low molecular weight polyacrylate type polymer such as a polyacrylate organic and/or inorganic detergent builders. A preferred solid builder salt is an alkali carbonate such as sodium carbonate or an alkali metal citrate sodium citrate or a mixture of sodium carbonate and sodium citrate. When a mixture of sodium carbonate and sodium citrate is used, a weight ratio of sodium citrate to sodium carbonate is about 9:1 to about 1:9, more preferably about 3:1 to about 1:3.

Other builder salts which can be mixed with the sodium carbonate and/or sodium citrate are gluconates phosphonates and nitriloacetic acid salts. In conjunction with the builder salts are optionally used low molecular weight polyacrylates having a molecular weight of about 1,000 to about 100,000, more preferably about 2,000 to about 80,000. A preferred low molecular weight polyacrylate is Sokalan TM CP45 manufactured by BASF and having a molecular weight of about 70,000. Another preferred low molecular weight polyacrylate is Acrysol TM LMW45ND manufactured by Rohm and Haas and having a molecular weight of about 4,500. Norasol TM WL2 comprises 26% LMW45ND sprayed on 74% soda ash.

Sokalan TM CP45 is a copolymer of an acrylic acid and an acid anhydride. Such a material should have a water absorption at 38° C. and 78 percent relative humidity of less than about 40 percent and preferably less than about 30 percent. The builder is commercially available under the tradename of Sokalan TM CP45 This is a partially neutralized copolymer of metacrylic acid and maleic anhydride sodium salt. Sokalan TM CP45 is classified as a suspending and anti-deposition agent. This suspending agent has a low hygroscopicity. Another builder salt is Sokalan TM CP5 having a molecular weight of 70,000. An objective is to use suspending and anti-redeposition agents that have a low hygroscopicity. Copolymerized polyacids have this property, and particularly when partially neutralized. Acusol TM 640ND provided by Rohm Haas is another useful suspending and anti-redepositing agent.

Another class of builders useful herein are the aluminosilicates, both of the crystalline and amorphous type. Various crystalline zeolites (i.e. alumino-silicates) are described in British Patent No. 1,504,168, U.S. Pat. No. 4,409,136 and Canadian Patent Nos. 1,072,835 and 1,087,477. An example of amorphous zeolites useful herein can be found in Belgium Patent No. 835,351. The zeolites generally have the formula $$(M_2O)_x(Al_2O_3)_y(SiO_2)_z\ wH_2O$$

wherein x is 1, y is from 0.8 to 1.2 and preferably 1, z is from 1.5 to 3.5 or higher and preferably 2 to 3 and w is from 0 to 9, preferably 2.5 to 6 and M is preferably sodium. A typical zeolite is type A or similar structure, with type 4A particularly preferred. The preferred aluminosilicates have calcium ion exchange capacities of about 200 milliequivalents per gram or greater, e.g. 400 meq/g.

The alkali metal silicates are useful anti-corrosion agents which function to make the composition anticorrosive to eating utensils and to automatic dishwashing machine parts. Sodium silicates of $Na_2O/SiO_2$ ratios of from 1:1 to 1:3.4, more preferably 1:1 to 1:2.8. Potassium silicates of the same ratios can also be used. The preferred silicates are sodium disilicate (anhydrous), sodium disilicate (hydrated) and sodium metasilicate and mixtures thereof, wherein the preferred silicate is hydrated disilicate.

Essentially, any compatible anti-foaming agent can be used. Preferred anti-foaming agents are silicone anti-foaming agents. These are alkylated polysiloxanes and include polydimethyl siloxanes, polydiethyl siloxanes, polydibutyl siloxanes, phenyl methyl siloxanes, dimethyl silinated silica, trimethysilanated silica and triethylsilanated silica. A suitable anti-foaming agent is Silicone TB-201 from Union Carbide. Other suitable anti-foaming agents are Silicone DB700 used at about 0.2 to about 1.0 percent by weight, sodium stearate used at a concentration level of about 0.5 to 1.0 weight percent and 1.0 weight percent, and LPKN 158 (phosphoric ester) sold by Hoechst used at a concentration level of about 0 to about 1.5 weight percent, more preferably about 0.1 to about 1.0 weight percent. The perfumes that can be used include lemon perfume and other natural scents. Essentially, any opacifier that is compatible with the remaining components of the detergent formulation can be used. A useful and preferred opacifier is titanium dioxide at a concentration level of about 0 to about 1.0 weight percent.

A key aspect is to keep the free water (non-chemically bonded water) in the detergent composition at a minimum. Absorbed and adsorbed water are two types of free water, and comprise the usual free water found in a detergent composition. Free water will have the affect of deactivating the enzymes. It will also serve to solubilize the available $Na_2O$ and thus increase the alkalinity of the detergent composition.

The detergent composition of the present invention includes a peroxygen bleaching agent at a concentration level of about 0 to about 20 weight percent, more preferably about 0.5 to about 17 weight percent and most preferably at about 1.0 to about 14 weight percent. The oxygen bleaching agents that can be used are alkali metal perborate, percarbonate, perphthalic acid, perphosphates, and potassium monopersulfate. A preferred compound is sodium perborate monohydrate. The peroxygen bleaching compound is preferably used in admixture with an activator at a concentration level of 1-5 wt. percent. Suitable activators are those disclosed in U.S. Pat. No. 4,264,466 or in column 1 of U.S. Pat. No. 4,430,244, both of which are herein incorporated by reference. Polyacetylated compounds are preferred activators. Suitable preferred activators are tetraacetyl ethylene diamine ("TAED"), pentaacetyl glucose and ethylidenebenzoate acetate. The activator usually interacts with the peroxygen compound to form a peroxyacid bleaching agent in the wash water.

The detergent formulation also contains a mixture of a proteolytic enzyme and an amylotytic enzyme and, optionally, a lipolytic enzyme that serve to attack and remove organic residues on glasses, plates, pots, pans and eating utensils. Proteolytic enzymes attack protein residues, lipolytic enzymes fat residues and amylolytic enzymes starches. Proteolytic enzymes include the protease enzymes subtilism, bromelin, papain, trypsin and pepsin. Amylolytic enzymes include amylase enzymes. Lipolytic enzymes include the lipase enzymes. The preferred amylase enzyme is available under the name Maxamyl, derived from Bacillus licheniformis and is available from Gist-Brocades of the Netherlands available in the form of a prill having an activity of about 6,000 TAU/g. The preferred protease enzyme is available under the name Maxapem 15 or Maxapem 42 which is a high alkaline mutant proteolytic enzyme derived from Bacillus alcalophylus, and is supplied by from Gist-Brocades, of the Netherlands in a prill form (activity of about 400,000 ADU/g.). Preferred enzyme activates per wash are Maxapem 420–840 KDU per wash and Maxamyl-4,000–8,000 TAU per wash.

The weight ratio of the proteolytic enzyme to the amylolytic enzyme in prill form the powdered automatic dishwasher detergent compositions is about 6:1 to about 1:1, and more preferably about 4.5:1 to about 1.1:1.

The detergent composition can have a fairly wide ranging composition. The surfactant can comprise about 0 to 15 percent by weight of the composition, more preferably about 0.1 to 15 percent by weight, and most preferably about 1 to about 12 percent by weight. The anti-foaming agent will be present in an amount of about 0 to about 1.5 percent by weight, more preferably about 0.1 to about 1.2 percent by weight and most preferably about 0.1 to about 1 percent by weight. The builder system, which is present in an amount of about 2 to about 40 percent by weight, more preferably about 4 to about 40 percent by weight and most preferably about 5 to about 30 percent by weight. The builder system also preferably contains the low molecular weight polyacrylate type polymer at a concentration level of about 0 to about 20 weight percent, more preferably 5 to about 17 weight percent and most preferably about 2 to about 14 weight percent. The composition also includes the peroxygen bleaching agent at a concentration of about 0 to 20 wt. percent and the activator at a concentration of about 1 to 5 wt. percent.

The alkali silicate, which is a corrosion inhibitor, wherein sodium disilicate is preferred, will be present in an amount of about 0 to 30 percent by weight, more preferably about 3 to about 30 percent by weight and most preferably about 4 to about 28 percent by weight.

The opacifier will be present in an amount of about 0 to about 1.0 percent by weight, more preferably about 0.1 to about 7 percent by weight and most preferably about 0.4 percent by weight.

The enzymes will be present in an amount in a prill form as supplied by Gist-Brocades at a concentration of about 0.8 to 22.0 percent by weight, more preferably about 0.9 to 20.0 percent by weight, and most preferably about 1.0 to about 18.0 percent by weight. The protease enzyme prills in the automatic dishwashing composition will comprise about 0.5 to about 15.00 percent by weight, more preferably about 0.7 to about 13.0 weight percent and most preferably about 0.8 to about 11.0 percent by weight. The amylase enzyme prills will comprise about 0.3 to about 8.0 percent by weight, more preferably about 0.4 percent to about 7.0 weight percent and most preferably about 0.5 to about 6.0 weight percent. The lipase enzyme will comprise about 0.00 to about 8.0 percent by weight of the detergent composition. A typical lipase enzyme is Lipolase 100 T from Novo Corporation. The lipase enzymes are especially beneficial in reducing grease residues and related filming problems on glasses and dishware. Another useful lipase enzyme is Amano PS lipase provided by Amano International Enzyme Co., Inc.

Other components such as perfumes will comprise about 0.1 to about 5.0 percent by weight of the detergent composition.

One method of producing the powder detergent formulation having a bulk density of about 0.8 is to spray dry by any conventional means the nonionic surfactant and defoamer onto the perborate bleach compound and the builder salt. This spray dry materials can be used immediately, but it is preferred to age it for 24 hours. The spray dried materials are dry blended in any suitable conventional blender such as a tumble blender at about room temperature with the other ingredients of the composition until a homogenous blend is obtained.

The instant compositions also can be produced as low density powders according to the procedure as set forth in U.S. Pat. No. 4,931,203 which is hereby incorporated by reference, wherein these powders have a bulk density less than the bulk density of the bulk density of the standard powders which have a bulk density of about 0.8 kg/liter.

The concentrated powdered nonionic automatic dishwashing detergent compositions of the present invention disperses readily in the water in the dishwashing machine. The presently used home dishwashing machines have a measured capacity for about 80 cc or 90 grams of detergent. In normal use, for example, for a full load of dirty dishes 60 grams of powdered detergent are normally used.

In accordance with the present invention only about 19 cc or about 15 grams of the concentrated powdered detergent composition is needed. The normal operation of an automatic dishwashing machine can involve the following steps or cycles: washing, rinse cycles with cold water and rinse cycles with hot water. The entire wash and rinse cycles require about 60 minutes. The temperature of the wash water is about 40° C. to about 65° C. and the temperature of the rinse water is about 55° C. to about 65° C. The wash and rinse cycles use about 4 to 7.5 liters of water for the wash cycle and about 4 to 7.5 liters of water for the hot rinse cycle.

The highly concentrated powdered automatic dishwashing detergent compositions exhibit excellent cleaning properties and because of the high concentration of the detergent in the composition, the detergent is not totally consumed during the wash cycle or totally eliminated during the rinse cycle such that there is a sufficient amount of detergent remaining during the rinse cycle to substantially improve the rinsing. The washed and dried dishes are free of undesirable traces, deposits or film due to the use of hard water in the rinse cycle.

DESCRIPTION OF THE PREFERRED EMBODIMENTS

Example 1

The concentrated powdered nonionic surfactant detergent composition was formulated from the following ingredients in the amounts specified according to the previously defined and described dry blending process.

TABLE I

| RAW MATERIALS | FORMULA COMPOSITIONS (IN PARTS) A | B | C | D | E |
|---|---|---|---|---|---|
| Anhydrous Sodium Metasilicate | 23 | 23 | 23 | 23 | — |
| Sodium Disilicate (at 22% water) | — | — | — | — | 32.6 |
| Nonionic coated Maxcal at 330 KADU/g | — | 8.0 | 16.0 | — | — |
| Nonionic coated Maxamyl at 5800 TAU/g | — | — | — | — | 5 |
| Nonionic coated Maxatase at 440 KDU/g | — | — | — | — | — |
| PEG Coated Maxacal at 350 KADU/g | — | — | — | — | — |
| PEG Coated Maxamyl at 5900 TAU/g | — | — | — | — | — |
| PEG Coated Maxapem CX30 at 600 KADU/g | — | — | — | — | 6.5 |
| SOKALAN CP45 at 6% water from BASF | 10 | 10 | 10 | 10 | 10 |
| SODA ASH | 34.2 | 34.2 | 34.2 | 34.2 | 26 |
| SODIUM CITRATE DIHYDRATED | — | — | — | — | — |
| TAED | — | — | — | — | 3 |
| SILICONE DB100 | 0.5 | 0.5 | 0.5 | 0.5 | 0.5 |
| SYNPERONIC LFD25 | 4.5 | 4.5 | 4.5 | 4.5 | 4.5 |
| SODIUM PERBRATE MONOHYDRATED | 10 | 10 | 10 | 10 | 10 |
| CAUSTIC SODA | — | — | — | — | 5 |
| LIPOLASE 100T (NOVO) | — | — | — | — | 1.9 |

Example II

Formulas (A–E) of Example 1 were tested in a European style Philips 664 Dishwasher working at 55° C. with a charge of 15.0 grams per wash of the Formulas (A–E) and 3 ml./per wash of commercial Galaxy rinse aid sold by Colgate-Palmolive Co. The load of items placed in the dishwasher consisted of 6 plates soiled with 3.0 grams of a mixture of 12.0 grams of porridge oats with 188 grams of water and 3 plates soiled with 0.4 grams of calcium chloride denaturated egg yolk and three plates soiled with 5 grams of a microwave oven baked mixture of 177 grams of egg yolk with 50 grams of margarine and 3 cups soiled with tea after overglaze removal wherein all the plates were dried prior to being placed in the dishwasher. The pH of the washing bath and the formulation were measured. The hardness of the rinse water was 38 ($C_aCO_3$) ppm. Each formulation was evaluated for spotting and filming. The results were evaluated on a scale of 1 to 10 with the higher number being the better result.

TABLE II

| TEST | CLEANING PERFORMANCE EVALUATIONS (AT 55° C.) A | B | C | D | E |
|---|---|---|---|---|---|
| SOIL REMOVAL | | | | | |
| OATMEAL | 7 | 7.5 | 8.5 | 10 | 10 |
| MICROEGGS | 5 | 7.5 | 9 | 5 | 7.3 |
| CALCIUM EGGS | 2 | 9 | 9.5 | 2 | 10 |
| FILMING | — | — | — | — | 7.0 |
| SPOTTING | — | — | — | — | 7.3 |
| GLASS DAYLIGHT | — | — | — | — | 9.0 |
| TEA STAIN | — | — | — | — | — |
| GREASY BUILD-UP ON STRAINER | — | — | — | — | — |
| GREASY BUILD-UP | | | | | |
| SPOTTING | — | — | — | — | 7.5 |
| FILMING | — | — | — | — | 7.1 |
| GLASS DAYLIGHT | — | — | — | — | 9.5 |
| GREASY BUILD-UP ON STRAINER | — | — | — | — | 9.0 |

The above described examples of illustrative compositions of the invention were evaluated for performance according to the following laboratory test methods.

All cleaning performance were carried out under European washing conditions in automatic dishwashers with a built-in heater and water softening ion-exchange resin, at a temperature range of about 50° C. to about 65° C. with 3 ml of a rinse aid (Galaxy Rinse Aid) used in the later stages of the cycle (automatically dispersed by a built-in closing device during the last rinse cycle). Fifteen grams of the illustrative compositions were used as a simple dose per wash.

In the so-called soil cleaning test, 3 cups and 2 sets of plates were identically soiled with food (tea stain, oatmeal soil, hardened egg soil and microwave oven-cooked egg soil). The cup staining was obtained by using 3 cups previously filled with a 5% fluorhydric acid solution during 15 minutes in order to remove the protection. The cups were washed and dried just before staining. The tea stain was prepared by adding 90 ml boiling water to one 2 g dose of LIPTON yellow label tea and leaving the system at test for 20 minutes. After emptying, the cups were then allowed to dry for 12 hours.

Oatmeal soil was prepared by boiling 24 grams of Quaker oats in 400 ml of tap water for ten minutes and then homogenized with a high shearing device (Ultrawax). Three grams of this mixture was spread as thin film onto 7.5 inch china plates. The plates were aged for 2 hours at 80° C., and then stored overnight at room temperature. Hardened egg soil was prepared by mixing egg yolk with an equal amount of 2.5N calcium chloride solution. 0.4 grams of this mixture was applied as a thin crosswise film to the usable surface of 7.5 inch china plates. Microwave-egg soil was prepared by mixing hot egg yolk and cooked margarine with a homogenizer (Ultraturax device). Five grams of this mixture were spread as thin film onto 7.5 inch china plates, and the soiled plates were baked afterwards for one minute in a microwave oven. The two type of egg soils were stored overnight at room temperature. Six plates of oatmeal, 3 cups soiled with tea, and three plates of each egg were used per wash, together with six clean glasses. The twelve soiled plates, the three soiled cups, and the six glasses were always placed in the same positions in the dishwasher at each run. In each test four different compositions were assessed using a series of four dishwashers.

All washed plates were scored each run by determining the percent area cleaned (percentage of soil removal) with the aid of a reference scale of gradually cleaned plates. Average percentages of soil removal for each type of soil after four runs were converted in a 0 to 10 scale, 0 being for no soil removal and 10 for perfect cleaning. Glasses were rated in a viewing box for filming and spotting and under natural lighting for 0.966 evaluation. They were rated according to a scale ranging from 0 (bad performance) to 10 (perfectly clean glasses) with the aid of reference glasses.

In the multisoil cleaning test different dishware/soil combinations were used. The dishwasher load included each run six plates of oatmeal, three cups soiled with tea, one dish of white sauce, one dish of rice, four glasses soiled with tomato juice, four glasses soiled with cocoa, and four soiled with milk. Pieces of cutlery (forks, knives and spoons, six each) were also included and soiled with porridge soil, rice and rice with cheese soils.

Same Latin Square procedure was used as for soil cleaning test. Percentages of soil removal on all the dishware and glasses were converted in 0 to 10 scale, 0 being for no soil removal and 10 for perfect cleaning. Glasses were also scored for filming, spotting redeposition of soils and global evaluation according to a 0 (bad performance) to 10 (very good performance) scale with the aid of reference glasses. A different scale was used to distinguish the data from soil removal performance. Results tabulated were average of four runs.

In the greasy residue build-up test, the dishwasher load included six clean plates in the lower basket and six clean glasses in the upper basket. The soil load was consisting of 100 grams of a greasy soil mixture prepared by mixing mustard (42 weight %) white vinegar (33 wt. %), corn oil (15 wt. %) and lard (10 wt. %) altogether.

In each test, four different compositions were assessed according to a Rubin Square procedure by using a series of four dishwashers during at the same time. 50 grams of greasy soil mixture were Poured each run in the wash bath together with fifteen grams of the detergent composition used as a single dose per wash. After each run, the upper basket containing the six glasses, the cutlery basket with the plastic tiles as well as the dishwasher filter elements were moved from one dishwasher to the following one, before conducting the next run. Such a procedure was used to assess the performance of compositions on glasses and on plastic dishware surfaces under conditions of repeated washer in the presence of said greasy soil mixture.

After each cycle, glasses were scored in a viewing box for filming and spotting and under natural lighting for 966d aspect according to the same 0 (bad performance) to 10 (perfectly clean glasses) scale as for the so-called soil cleaning test with the aid of reference glasses.

The same procedure was repeated three times using the same set of glasses so as to calculate average performance results for each composition after 4 cycles. The dishwashers filter parts were also inspected after each cycle to evidence greasy deposit build up differences between compositions.

What is claimed is:

1. A powdered automatic dishwashing composition which has a bulk density of less than about 0.8 kg./liter which by weight comprises:

(a) a builder system comprising:

(i) 2.0 to 40.0 percent of at least one alkali metal detergent builder salt; said detergent builder salt being selected from the group consisting essentially of alkali metal carbonates and alkali metal citrates and mixtures thereof:

(ii) 1.0 to 17.0 percent of a low molecular weight polyacrylate polymer;

(b) 1.0 to 12.0 percent of a liquid nonionic surfactant, said liquid nonionic surfactant being absorbed on said builder system;

(c) a blend of:

(i) 3.0 to 30.0 percent of an alkali metal silicate;

(ii) 0.1 to 1.5 percent of an antifoaming agent;

(iii) 0.5 to 15.0 percent of a protease enzyme derived from a high alkaline mutant proteolytic enzyme derived from bacillus alcalophylus;

(iv) 0.3 to 8.0 % of an amylase enzyme, said blend being mixed with said builder system, said composition having less than 8.0 weight percent of water and a 1.0 wt. percent aqueous solution of said composition having a pH of less than about 10.5.

2. A method of cleaning dishes, glasses, cups and eating utensils in an automatic dishwashing machine which comprises adding to the wash water in said dishwashing machine a powdered automatic dishwashing composition which by weight comprises:

(a) A builder system comprising:

(i) 2.0 to 40.0 percent of at least one alkali metal detergent builder salt, said detergent builder being selected from the group consisting essentially of alkali metal carbonate and alkali metal citrate and mixtures thereof; and (ii) 1.0 to 17.0 percent of a low molecular weight polyacrylate polymer, (b) 1.0 to 12.0 percent of a liquid nonionic surfactant, said liquid nonionic surfactant being absorbed on said builder system;

(c) a blend of:

(i) 3.0 to 30.0 percent of an alkali metal silicate;

(ii) 0.1 to 1.5 percent of an antifoaming agent;

(iii) 0.5 to 15.0 percent of a protease enzyme derived from a high alkaline mutant proteolytic enzyme derived from Bacillus alcalophylus;

(iv) 0.3 to 8.0 percent of an amylase enzyme, said blend being mixed with said builder system having said nonionic surfactant absorbed on said builder system, said composition having less than 8.0 weight percent of water and a 1.0 wt. percent aqueous solution of said composition having a pH of less than about 10.3.

3. A method according to claim 1 wherein said dishwashing composition further contains a lipase enzyme.

4. The method according to claim 1 wherein said dishwashing composition contains a bleaching agent.

5. The method according to claim 4 wherein said dishwashing composition contains a bleaching activator.

6. The method according to claim 1, wherein a weight ratio of the protease enzyme to the amylase enzyme is about 2:1 to about 1.1:1.

7. The powdered dishwashing composition according to claim 2 wherein said dishwashing composition further contains a lipase enzyme.

8. The powdered dishwashing composition according to claim 2 which includes about 0 to 20.0 percent by weight of a copolymerized polyacrylic acid.

9. The concentrated powdered dishwashing composition according to claim 7 which contains an alkali metal perborate activator.

* * * * *